US008033786B2

(12) United States Patent
Durocher et al.

(10) Patent No.: US 8,033,786 B2
(45) Date of Patent: Oct. 11, 2011

(54) AXIAL LOADING ELEMENT FOR TURBINE VANE

(75) Inventors: Eric Durocher, Vercheres (CA); John Pietrobon, Outremont (CA); Alan Juneau, Mont Royal (CA); Dennis English, Candiac (CA)

(73) Assignee: Pratt & Whitney Canada Corp., Longueuil (CA)

( * ) Notice: Subject to any disclaimer, the term of this patent is extended or adjusted under 35 U.S.C. 154(b) by 971 days.

(21) Appl. No.: 11/954,320

(22) Filed: Dec. 12, 2007

(65) Prior Publication Data

US 2009/0155069 A1 Jun. 18, 2009

(51) Int. Cl.
*F01D 9/04* (2006.01)

(52) U.S. Cl. ..... 415/189; 415/191; 415/209.2; 415/209.4; 416/192; 416/206; 416/208; 416/209

(58) Field of Classification Search ..... 415/189, 415/190, 191, 209.2, 209.3, 209.4; 416/192, 416/204 A, 206, 208, 209
See application file for complete search history.

(56) References Cited

U.S. PATENT DOCUMENTS

| | | | | |
|---|---|---|---|---|
| 4,314,793 | A | 2/1982 | DeTolla et al. | |
| 4,909,708 | A | 3/1990 | Albrecht | |
| 5,145,316 | A | 9/1992 | Birch | |
| 5,149,250 | A | 9/1992 | Plemmons et al. | |
| 5,269,651 | A | 12/1993 | Ostermeir et al. | |
| 5,346,362 | A | 9/1994 | Bonner et al. | |
| 5,653,580 | A | 8/1997 | Faulder et al. | |
| 6,435,820 | B1 | 8/2002 | Overberg | |
| 7,195,452 | B2 | 3/2007 | Allan et al. | |
| 7,300,246 | B2 * | 11/2007 | Durocher et al. | 415/191 |
| 7,762,768 | B2 * | 7/2010 | Shi et al. | 415/209.3 |

* cited by examiner

*Primary Examiner* — Igor Kershteyn
(74) *Attorney, Agent, or Firm* — Norton Rose OR LLP

(57) ABSTRACT

A vane assembly for a gas turbine engine comprising an axial loading element disposed between a mounting element of the vane ring and a cooperating portion of the supporting structure, such as to generate a load force therebetween in an axial direction. The axial load force limits unwanted relative movement between the vane ring and the supporting structure during operation of the gas turbine engine.

16 Claims, 3 Drawing Sheets

AXIAL LOADING ELEMENT FOR TURBINE VANE

TECHNICAL FIELD

The present invention relates generally to gas turbine engines, and more particularly to turbine vane assemblies thereof.

BACKGROUND OF THE INVENTION

The turbine section of gas turbine engines typically includes a number of stages of turbine vanes, each composed of a plurality of radially extending vanes which are mounted within a common support structure and often compose vane ring assemblies. Each of the turbine vanes is mounted within a surrounding support of the vane ring assembly. While the turbine vanes must be maintained in place, sufficient allowance must be made for thermal growth differential between the vanes and their supporting structure, give the high temperatures to which the turbine vanes are exposed. As such, a given amount of axial and/or radial looseness is provided between the vane and its support, such as to permit thermal growth and thus to allow for axial and/or radial movement of the vane within the support while minimizing any potential friction therebetween. However, such tolerances which allow for thermal growth can sometimes cause undesirable movement of the vanes at certain temperatures, which can lead to engine vibration.

SUMMARY OF THE INVENTION

It is an object to provide an improved turbine vane assembly for a gas turbine engine.

In accordance with one aspect of the present invention, there is provided a vane assembly for a gas turbine engine, the vane assembly comprising a plurality of airfoils radially extending between an inner and outer vane platforms defining a gas path therebetween, the vane assembly being concentric with a longitudinal axis of the gas turbine engine, at least the inner platform having a mounting member protruding therefrom and disposed in engagement with a corresponding cooperating portion of a supporting structure of the vane assembly such as to at least partially support and position the vane assembly in place within the gas turbine engine, and wherein an axial loading element is disposed between the mounting member of the vane assembly and the cooperating portion of the supporting structure to generate an axial load force therebetween, the axial load force limiting relative axial movement between the vane assembly and the supporting structure during operation of the gas turbine engine.

There is also provided, in accordance with another aspect of the present invention, a vane assembly for a gas turbine engine, the vane assembly comprising a vane support and a vane ring, the vane ring including a plurality of airfoils radially extending between inner and outer vane platforms, the vane ring being concentric with a longitudinal axis of the gas turbine engine, the vane ring having mounting members radially protruding therefrom, the mounting members being disposed in engagement with corresponding recesses of the vane support, and a means for generating an axial load force against the vane support, said means axially biasing the vane ring relative to the vane support thereby limiting relative axial movement between the vane ring and the vane support during operation of the gas turbine engine.

There is further provided, in accordance with another aspect of the present invention, a method of reducing vibration in a gas turbine engine having a turbine vane assembly including a plurality of airfoils radially extending between an inner and outer vane platforms defining a gas path therebetween, the vane assembly being concentric with a longitudinal axis of the gas turbine engine, the method comprising generating a substantially constant axial load force against a portion of at least one of the inner and outer vane platforms outside of the gas path, thereby axially biasing the vane assembly into contact with a supporting structure while permitting relative radial displacement therebetween.

BRIEF DESCRIPTION OF THE DRAWINGS

Further features and advantages of the present invention will become apparent from the following detailed description, taken in combination with the appended drawings, in which.

DETAILED DESCRIPTION OF A PREFERRED EMBODIMENT

Figure 1:
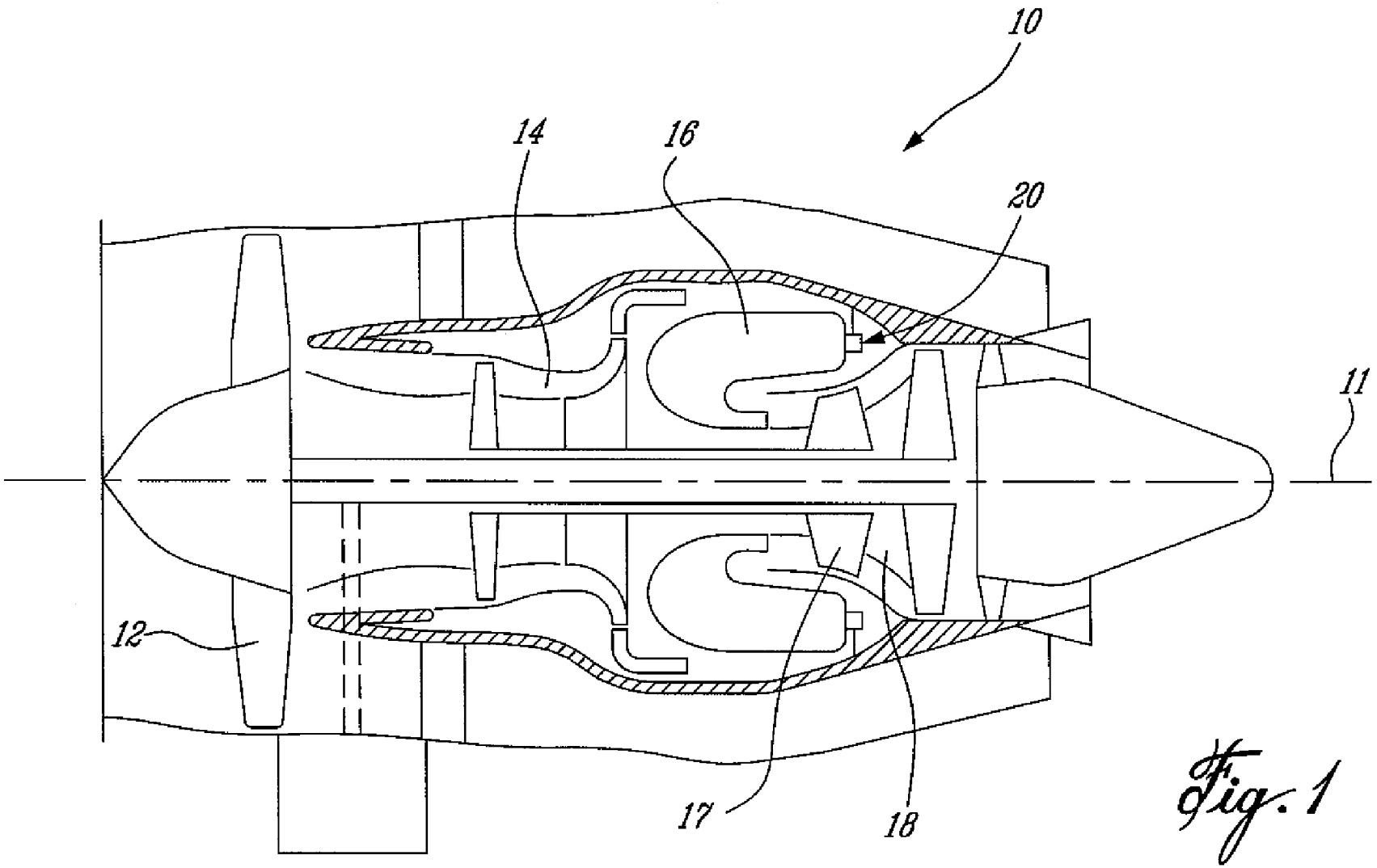
FIG. 1 is schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Fuel is injected into the combustor 16 of the gas turbine engine 10 by a fuel injection system 20 which is connected in fluid flow communication with a fuel source (not shown) and is operable to inject fuel into the combustor 16 for mixing with the compressed air from the compressor 14 and ignition of the resultant mixture. The fan 12, compressor 14, combustor 16, and turbine 18 are preferably all concentric about a common central longitudinal axis 11 of the gas turbine engine 10.

Figure 2:
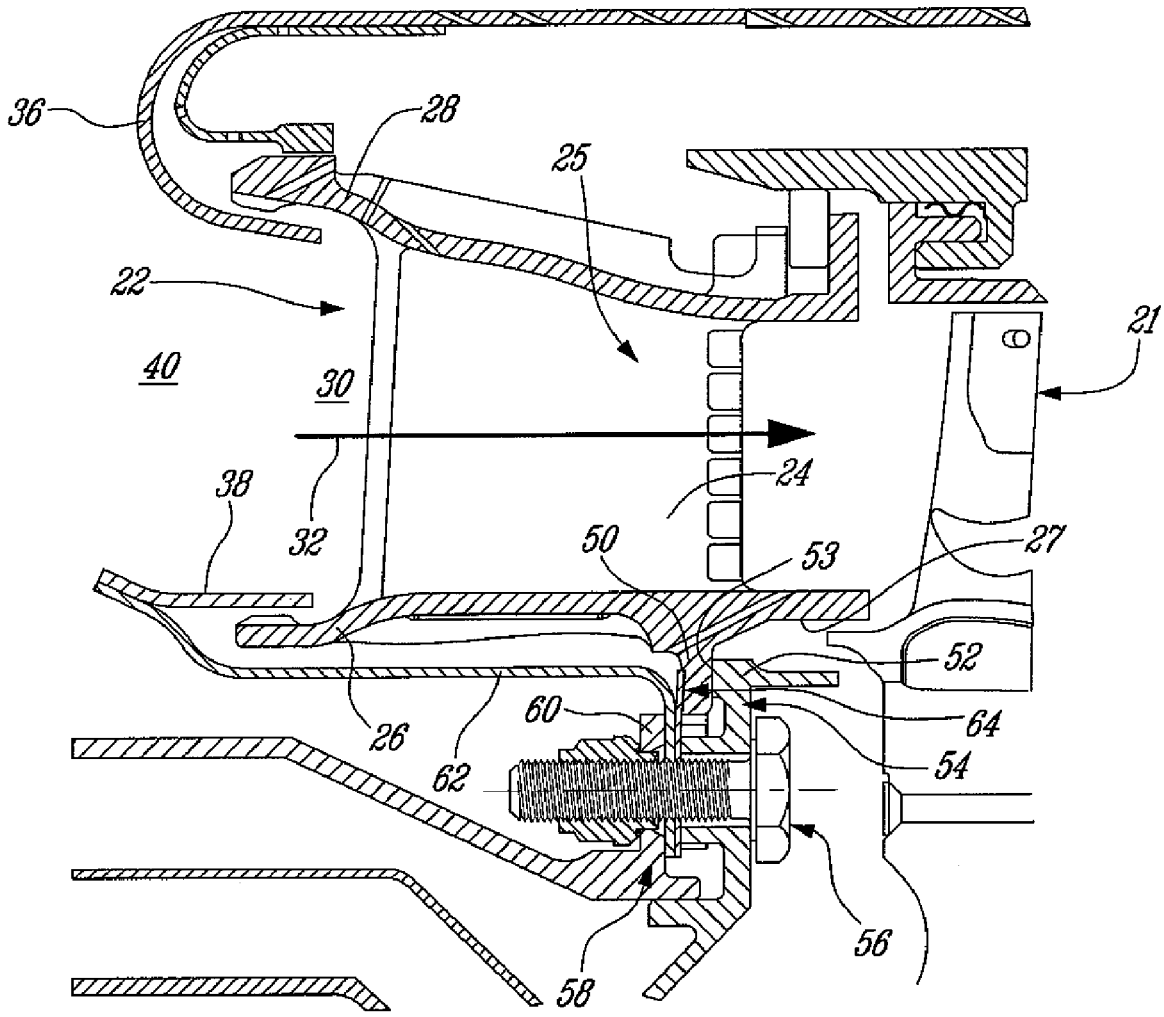
FIG. 2 is a partial cross-sectional view of a turbine vane assembly in accordance with one aspect of the present invention.

The turbine section 18 of the gas turbine engine 10 may comprise one or more turbine stages. In this case two are shown, including a first, or high pressure (HP), turbine stage 17. As seen in FIG. 2, the HP turbine stage 17 includes a rotating turbine rotor 21 with a plurality of radially extending turbine blades and a static turbine vane assembly 22, in accordance with the present invention, which is mounted upstream of the turbine rotor 21.

Referring to FIG. 2 in more detail, the turbine vane assembly 22 of the HP turbine stage 17 is disposed immediately downstream from the combustion chamber exit 40 of the combustor 16, and is engaged to the radially outer and inner 36, 38 duct walls of the combustor exit. The turbine vane assembly 22 comprises generally a vane ring having plurality of airfoils 24 which extend substantially radially between an inner vane platform 26 and an outer vane platform 28, which define an annular gas flow passage 30 therebetween. The outer vane platform 28 sealingly engages the outer combustion chamber wall 36 and the inner vane-platform 26 sealingly engages the inner combustion chamber wall 38, thereby defining therebetween the annular hot gas path from the combustion chamber outlet 40 through the annular passage 30 in axial fluid flow direction 32. The vane ring is mounted to a supporting vane support structure 54, as will be described further below.

The vane ring of the turbine vane assembly 22 comprises an annular stator vane ring 25 which makes up the vane assembly. The vane ring 25 comprises a plurality of airfoils 24 integrally formed with, and radially extending between, each inner platform 26 and outer platform 28.

At least the inner vane platform 26 of the vane ring 25 includes a mounting member 50 which protrudes therefrom and is disposed in engagement with a corresponding and cooperating flange portion 52 of a supporting structure 54. In the depicted embodiment, the mounting member 50 of the vane assembly radially protrudes inwardly from the vane platform surface 27 disposed opposite the gas path. The supporting structure is fixed within the engine, by being fastened to the engine casing for example, such as to at least partially support and position the vane assembly in place within the gas turbine engine when the vane assembly 22 is engaged thereto. A threaded fastener 56 is used to axially retain the mounting member 50 of the vane assembly 22, by locating it between an abutting surface 53 of the flange portion 52 and an axially spaced apart retaining member 58. The retaining member 58 may include a retaining ring or ring segment 60 and/or a portion of a heat shield 62 which is mounted adjacent the vane assembly 22. The protruding mounting member 50 of the vane assembly is therefore axially restrained between the flange portion 52 and the retaining member 58, however movement of the mounting member 50, and therefore the entire vane assembly 22, in a radial direction remains possible between the flange portion 52 and the retaining member 58 of the supporting structure, such as to allow for radial thermal growth differential and/or relative radial movement therebetween during operation of the gas turbine engine.

Figure 3:
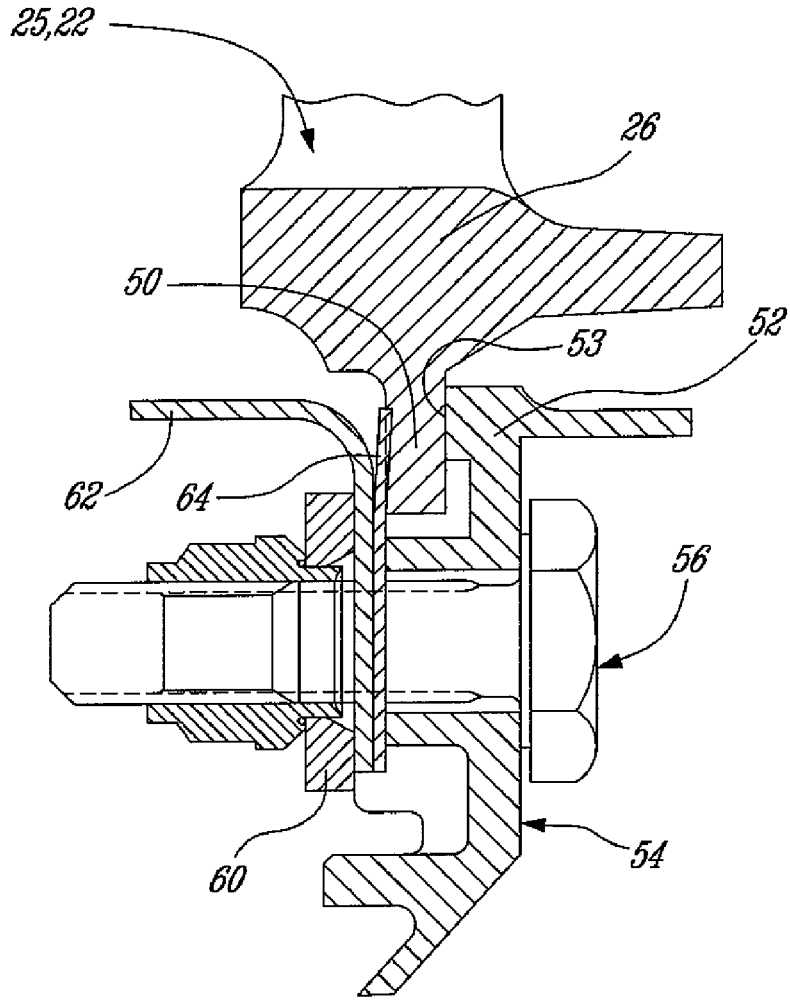
FIG. 3 is an enlarged view of a portion of the turbine vane assembly of FIG. 2.
Figure 4:
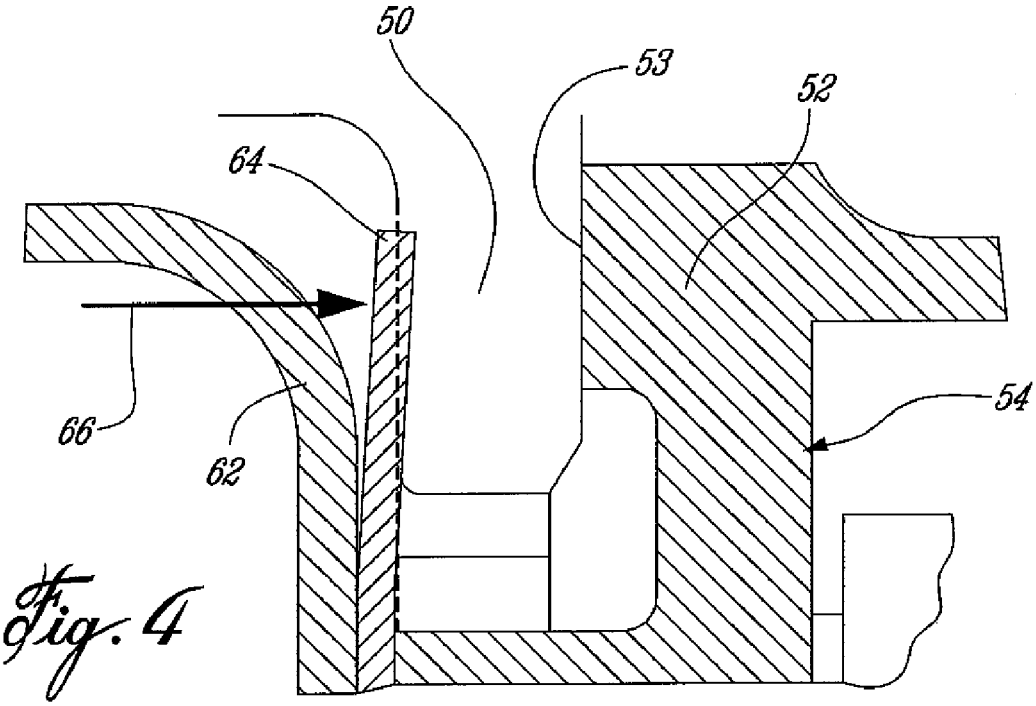
FIG. 4 is an enlarged view of a portion of FIG. 3.

As seen in FIGS. 2-4, an axial loading element 64 is also provided in the mounting assembly of the vane assembly within the supporting structure 54. More specifically, the axial loading element 64 is axially disposed between the protruding mounting member 50 of the inner platform 26 of the vane assembly 22 and the retaining member 58. As such, when the fastener 56 axially clamps the entire assembly together, the axial loading element 64 acts as a biasing element or spring, exerting an axially-directed spring load force 66 against the mounting member 50, thereby forcing it against the abutting surface 53 of the mounting structure's flange portion 52. The compressive load force 66 in an axial direction in thus transmitted from the mounting member 50 to the supporting structure (in this case the flange portion 52 thereof), thereby biasing the mounting member 50 against the flange 52 and thus helping to prevent unwanted relative movement between the vane ring 25 and/or vane assembly 22 and the supporting structure 54 during operation of the gas turbine engine 10. The axial load force provided by the axial load element 64 is directed in the same direction as an axial aerodynamic load exerted upon the vane assembly during operation of the gas turbine engine.

The axial loading element 64 may be formed in a variety of manners, however in at least one embodiment comprises a relatively thin sheet metal portion which is plastically deformed (i.e. bent) to provide a spring plate which tends to return to its bent configuration when flattened. Other forms, shapes and configurations of spring elements are also possible, providing they are able to generate a spring load force in an axial direction when mounted in the support assembly for engaging the vane assembly 22 to the supporting structure 54 within the engine.

The axial loading element 64 may be a single, annular sprung ring or alternately a plurality of smaller spring elements 64 which are disposed about the annular vane assembly 22 when installing same within the engine. In an alternate embodiment, the axial loading element 64 is comprised of the downstream (relative to the gas flow through the turbine section) end of the heat shield 62. For example, this downstream end of the heat shield 62, which is disposed between the nut of the fastener 56 and the mounting member 50 of the vane assembly 22, can be provided with a bend or other sprung portion therein such as to provide the axial load force 66 directly on the mounting member 50.

The constant axial force generated by the axial loading element 64 which is applied against the turbine vane assembly 22 therefore avoid unwanted relative movement between the turbine vane assembly and the supporting structure, which accordingly reduces unwanted engine vibration. This constant axial load force is useful when the engine is running at low power or at transient power conditions, as the reduced aerodynamic force (relative to the higher aerodynamic force which acts against the vane assembly at higher power conditions) which acts on the vane assembly is less effective at keeping the vane in place. The axial loading element 64 nevertheless permits for radial growth differential and/or relative radial movement, without requiring the axial "looseness" previously employed in order to accommodate such thermal growth of the vane assembly relative to the cooler supporting structure. Friction wear between the vane assembly and its mounting structure is also reduced by the use of the axial loading element 64.

As a result of the reduced vane displacement which occurs during engine operation when the axial loading element 64 is provided in the vane assembly, several other benefits are also achieved. In tests, these benefits have been found to include: the significant reduction in engine vibration; reduce wear or fretting on the support structure engaged with the vane; improved lifespan of seals disposed between the vane assembly and the other components of the engine; and the improved sealing efficient which thereby improves the stability of overall engine performance. For example, in one set of tests wherein a gas turbine engine having a vane assembly 22 with an axial loading element 64 was run on a test rig, a reduction of 30%-50% in overall engine vibration was measured.

The term 'axial' as used herein is intended to refer to a direction which is substantially parallel relative to the longitudinal engine axis 11 of the engine.

Although the vane assembly 22 has been described herein with reference to a turbine vane assembly, it is to be understood that the present vane assembly 22 can also be used in the compressor section of the engine as a compressor vane assembly. The mounting structure and axial load element described above are equally applicable to a compressor vane assembly if desired. Further, although the axial load element has been described above with respect to the inner vane platform mounting structure, it is to be understood that such an axial load element can also be provided between a mounting member of the vane outer platform and the corresponding support structure, in addition to or in place of that used for engaging the vane inner platform to the support structure within the engine.

The embodiments of the invention described above are intended to be exemplary. Those skilled in the art will therefore appreciate that the forgoing description is illustrative only, and that various other alternatives and modifications can be devised without departing from the spirit of the present invention as defined by the appended claims. Accordingly, the present is intended to embrace all such alternatives, modifications and variances which fall within the scope of the appended claims.

The invention claimed is:

1. A vane assembly for a gas turbine engine, the vane assembly comprising a plurality of airfoils radially extending between an inner and outer vane platforms defining a gas path therebetween, the vane assembly being concentric with a longitudinal axis of the gas turbine engine, at least the inner platform having a mounting member protruding therefrom and disposed in engagement with a corresponding cooperating portion of a supporting structure of the vane assembly such as to at least partially support and position the vane assembly in place within the gas turbine engine, and wherein an axial loading element is disposed between the mounting member of the vane assembly and the cooperating portion of the supporting structure to generate principally axial load force therebetween, the axial load force limiting relative axial movement between the vane assembly and the supporting structure during operation of the gas turbine engine, and wherein the axial loading element is a biasing element which exerts said principally axial load force directly against the mounting member thereby forcing the mounting member into contact with an abutting surface of the supporting structure, the biasing element including a sheet metal spring plate that is distinctly formed from the cooperating portion of the supporting structure of the vane assembly.

2. The vane assembly as defined in claim 1, wherein the axial load force is directed in the same direction as an axial aerodynamic load exerted upon the vane assembly during operation of the gas turbine engine.

3. The vane assembly as defined in claim 1, wherein the vane assembly is a turbine vane assembly.

4. The vane assembly as defined in claim 1, wherein vane assembly includes a heat shield disposed adjacent at least said inner platform outside of the gas path, and the axial loading element is comprised of a downstream end of the heat shield relative to flow through the gas path.

5. The vane assembly as defined in claim 1, wherein the vane assembly includes an annular stator vane ring having a plurality of said mounting members thereon, and said axial loading element being in contact with each of said mounting members.

6. The vane assembly as defined in claim 5, wherein a plurality of said axial loading elements are provided, each being disposed in contact with a respective one of said mounting members of said annular stator vane ring.

7. The vane assembly as defined in claim 1, wherein the axial loading element is a single annular spring plate.

8. The vane assembly as defined in claim 1, wherein the axial loading element comprises a plurality of individual spring elements which are circumferentially disposed about the annular vane assembly.

9. The vane assembly as defined in claim 1, wherein at least one fastener axially engages the vane assembly to the supporting structure.

10. A vane assembly for a gas turbine engine, the vane assembly comprising a vane support and a vane ring, the vane ring including a plurality of airfoils radially extending between inner and outer vane platforms, the vane ring being concentric with a longitudinal axis of the gas turbine engine, the vane ring having mounting members radially protruding therefrom, the mounting members being disposed in engagement with corresponding recesses of the vane support, and a means for generating principally axial load force directly against the vane support, said means axially biasing the vane ring relative to the vane support thereby limiting relative axial movement between the vane ring and the vane support during operation of the gas turbine engine, said means comprising at least one axial loading element disposed about the vane ring, said axial loading element including an annular sheet metal spring plate that is distinct from either the vane ring and the vane support.

11. The vane assembly as defined in claim 10, wherein the axial loading element generates a substantially constant axial load force against the vane ring.

12. The vane assembly as defined in claim 11, wherein the axial load force is directed in the same direction as an axial aerodynamic load exerted upon the vane assembly during operation of the gas turbine engine.

13. A method of reducing vibration in a gas turbine engine having a turbine vane assembly including a plurality of airfoils radially extending between an inner and outer vane platforms defining a gas path therebetween, the vane assembly being concentric with a longitudinal axis of the gas turbine engine, the method comprising generating a substantially constant load force in a principally axial direction against a portion of at least one of the inner and outer vane platforms outside of the gas path using an annular sheet metal spring plate that is distinctly formed from either the vane assembly and a supporting structure in the gas turbine engine, thereby axially biasing the vane assembly into contact with the supporting structure while permitting relative radial displacement therebetween.

14. The method of claim 13, wherein the step of generating includes exerting the axial load force on a protruding mounting member of the vane assembly.

15. The method of claim 14, further comprising exerting the axial load force on an inner platform of the vane assembly.

16. The method of claim 13, further comprising directing the axial load force in the same direction as an axial aerodynamic load exerted upon the vane assembly during operation of the gas turbine engine.

* * * * *